US005153021A

United States Patent [19]

Litchfield et al.

[11] Patent Number: 5,153,021

[45] Date of Patent: Oct. 6, 1992

[54] ABRADABLE SEAL COATING AND METHOD OF MAKING THE SAME

[75] Inventors: William B. Litchfield, Nottingham; Kenneth W. Wright, Derby, both of England

[73] Assignee: Rolls-Royce plc, London, England

[21] Appl. No.: 642,352

[22] Filed: Jan. 17, 1991

[30] Foreign Application Priority Data

Mar. 23, 1990 [GB] United Kingdom ..... 9006535

[51] Int. Cl.[5] ..... B05D 3/06; B05D 3/08; B05D 3/14; B05D 5/00

[52] U.S. Cl. ..... 427/447; 427/198; 427/199; 427/201; 427/191; 427/195

[58] Field of Search ..... 427/34, 197, 198, 199, 427/201, 421, 422, 423, 189, 190, 192, 195; 219/121.47

[56] References Cited

U.S. PATENT DOCUMENTS

| | | | |
|---|---|---|---|
| 3,084,064 | 4/1963 | Cowden et al. | 75/246 |
| 3,340,084 | 9/1967 | Eisenlohr | 427/723 |
| 3,890,069 | 6/1975 | Telang et al. | 427/34 |
| 3,910,734 | 10/1975 | Telang | 427/34 |
| 4,094,673 | 6/1978 | Erickson et al. | 75/246 |
| 4,299,865 | 11/1981 | Clingman et al. | 427/243 |
| 4,330,575 | 5/1982 | Litchfield et al. | 427/423 |
| 4,358,485 | 11/1982 | Kern et al. | 427/380 |
| 4,696,855 | 9/1987 | Pettit, Jr. et al. | 427/34 |
| 4,759,957 | 7/1988 | Eaton et al. | 427/423 |
| 5,024,884 | 6/1991 | Otfinski | 427/34 |
| 5,080,934 | 1/1992 | Naik et al. | 427/423 |
| 5,094,877 | 3/1992 | Bieringer et al. | 427/423 |

*Primary Examiner*—Marianne Padgett
*Attorney, Agent, or Firm*—Oliff & Berridge

[57] ABSTRACT

An abradable seal coating for application to one of a pair of members having relative rotational movement and its method of manufacture are described.

The abradable seal coating comprises a two phase composition consisting of a first phase of a metallic alloy matrix of approximately 88% aluminium - 12% silicon, and a second phase of an organic dispersoid material. The first and second phases are codeposited onto a substrate in the ratio 80:20 respectively.

The two phases are modified after codisposition onto the substrate by heat treating at a temperature of 450° C. for about sixteen hours. The heat treated coating can be used at elevated temperatures and has improved abradability whilst maintaining its integrity.

4 Claims, 2 Drawing Sheets

80/20 Al/Si POLYESTER AS SPRAYED × 100

80/20 H/T 16 HRS 450 C × 100

ABRADABLE SEAL COATING AND METHOD OF MAKING THE SAME

This invention relates to an abradable seal coating applied to an at least one of a pair of members having relative rotational movement and to a method of manufacturing such an abradable seal coating. In particular the invention relates to a coating which has the desired abradability to enable a rotating member to cut its own clearance in the abradable seal coating when applied to a cooperating stationary member. Such abradable seal coatings have applications in turbomachinery such as axial flow compressors and turbines.

In turbomachinery such as axial flow compressors and turbines, the efficiency depends on control of gas stream leakage which occurs between the stationary and rotating members. Leakage between the stationary and rotating members reduces the effective extraction of energy from the gas stream and thus the overall operating efficiency of the turbomachine is adversely affected.

Maintaining sufficient clearance between the rotating and stationary members of a turbomachine is difficult to achieve due to the adverse working conditions. Machining components to very close tolerances to give a desired clearance is not only expensive but is not effective as when the operating conditions become more strenuous these tolerances change. Under normal operating conditions the assembly will be subjected to high temperatures, high pressures and high rotational speeds which may cause the clearance to increase or decrease. The latter could result in frictional contact between the members which causes damage to either and may initiate titanium fires.

The primary cause of titanium fires in turbomachines is debris released from the rotating members as they wear on contacting the stationary members. The burning debris released from the rotating member impacts adjacent members and under appropriate conditions titanium fires are initiated. Therefore in the interest of safety there is a need to remove the possibility of titanium fires by removing the possibility of members wearing. Increasing the clearance between the members whilst preventing wearing would permit the gas stream to escape so reducing the overall efficiency.

Abradable sealing means have therefore been employed in such applications. The stationary member, such as a compressor or turbine housing is coated with an abradable seal to give essentially zero clearance with the rotating member. The rotating member, blade tips of the compressor or turbine, in operation interfere with the abradable seal; the frictional contact wearing away the coating to produce a channel. The blades can expand or contract within this channel with no damage to either the rotating or stationary members, whilst also maintaining the minimum clearance possible. This abradable coating technique not only increases the operating efficiency of the turbomachinery it also removes the possibility of titanium fires being initiated.

Abradable seal coatings have a limited temperature of operation above which their abradability improves but they lose their integrity. Their loss of integrity is such that a gas stream flowing through the assembly will cause the coating to erode.

SUMMARY OF THE INVENTION

The present invention seeks to provide an abradable seal coating for use at elevated temperatures, which has improved abradability whilst also maintaining its integrity.

According to the present invention, an abradable seal coating on at least one of a pair of members having relative rotational movement comprises a two phase composition consisting of a first phase of a metallic alloy matrix of approximately 88% aluminium and approximately 12% silicon, and a second phase of an organic dispersoid material, the first and second phases being codeposited onto the at least one member in a ratio of approximately 80:20 respectively, the two phases being modified after codisposition onto the at least one member by heating to a temperature of about 450° C. for a period of about 16 hours.

Preferably the organic dispersoid is a polyester powder having a mesh size of −140−+325 (US standard sieve).

A method of manufacturing an abradable seal coating on at least one of a pair of members having relative rotational movement comprises the steps of codepositing a first phase of a metallic alloy matrix of approximately 88% aluminium and approximately 12% silicon and a second phase of an organic dispersoid material in a ratio 80:20 respectively onto the at least one member to form a coating of the desired depth and heating the at least one coated member to an elevated temperature of about 450° for a period of about 16 hours so that the coating has improved abradability whilst maintaining its integrity.

Preferably the first and second phases are codeposited onto the at least one member by plasma spraying. The first and second phase are preferably heated prior to codepositing them onto the at least one member.

BRIEF DESCRIPTION OF THE DRAWINGS

The invention will now be more particularly described with reference to the accompanying drawings in which.

DETAILED DESCRIPTION

A substrate was plasma sprayed to a depth of 0.25 inches with a coating comprising a metallic alloy matrix of 88% aluminium—12% silicon with an organic dispersoid incorporated. The organic dispersoid was a polyester powder known as Metco 600 which has a mesh size of −140−325.

The metallic alloy matrix of 88% aluminium—12% silicon of the polyester powder were codeposited onto the substrate, in a ratio 80:20 respectively, by plasma spraying. Although the plasma spraying process is preferred it will be appreciated by one skilled in the art that any other suitable process and equipment may be used to deposit the coating. The polyester powder is hydroscopic and it was therefore found to be advantageous to heat the polyester to remove the excess water, which may cause the powder to coalesce, prior to its deposition onto the substrate.

After codisposition of the metallic alloy matrix of the polyester powder onto the substrate, the coating was machined to the final thickness required, normally of order of 0.1 inch. The thickness of the coating will depend upon the component design, its application and the tolerances required.

Figure 1:
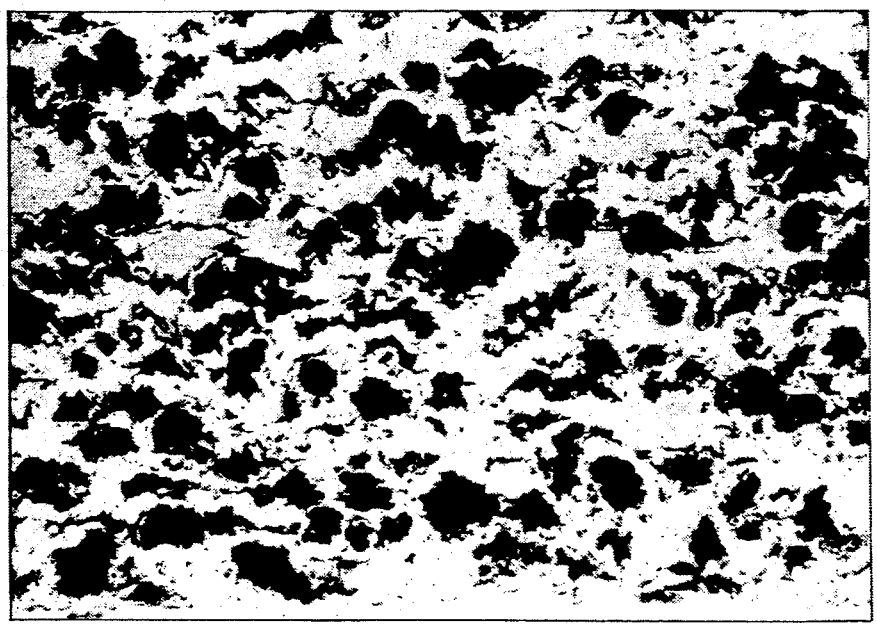
FIG. 1, shows a microsection of a sample of an abradable seal coating consisting of an aluminium—12% silicon metallic alloy matrix with a polyester dispersoid incorporated sprayed in ratio 80:20 onto a substrate.

A microsection of the sprayed coating was then taken for metallographic preparation. The microsection taken was impregnated with an epoxy resin so that it retained its structure whilst under examination. FIG. 1 shows the typical structure of the coating as sprayed. It shows the aluminium—12% silicon metallic alloy matrix (the white region in the photograph) with the polyester dispersoid incorporated (black regions in the photograph) magnified 100 times.

The hardness and erosion resistance of the coating as sprayed was then tested. The hardness was measured using the Rockwell R15Y indentation scale which indicates the abradability of the coating. The coating requires a good abradability, low hardness or R15Y indentation value, so that the material is removed from coating on being contacted by a cooperating member. It however further requires sufficient erosion resistance (integrity) to withstand erosion by a fluid stream flowing over it.

The 80/20 aluminium—12% silicon metallic alloy matrix with polyester powder dispersoid, as sprayed was found to have a Rockwell R15Y indentation value of order of 75±5R15Y and an erosion factor of order of 0.98. The erosion factor shows that the coating has a good resistance to a fluid flow over it, however the high indentation value meant that the coating did not have the desired abradability and was found to be too aggressive under certain conditions causing damage to the cooperating members.

To reduce the R15Y indentation value so as to achieve the desired abradability, the coating as sprayed was heat treated by soaking at a temperature of 450° C.

Figure 3:
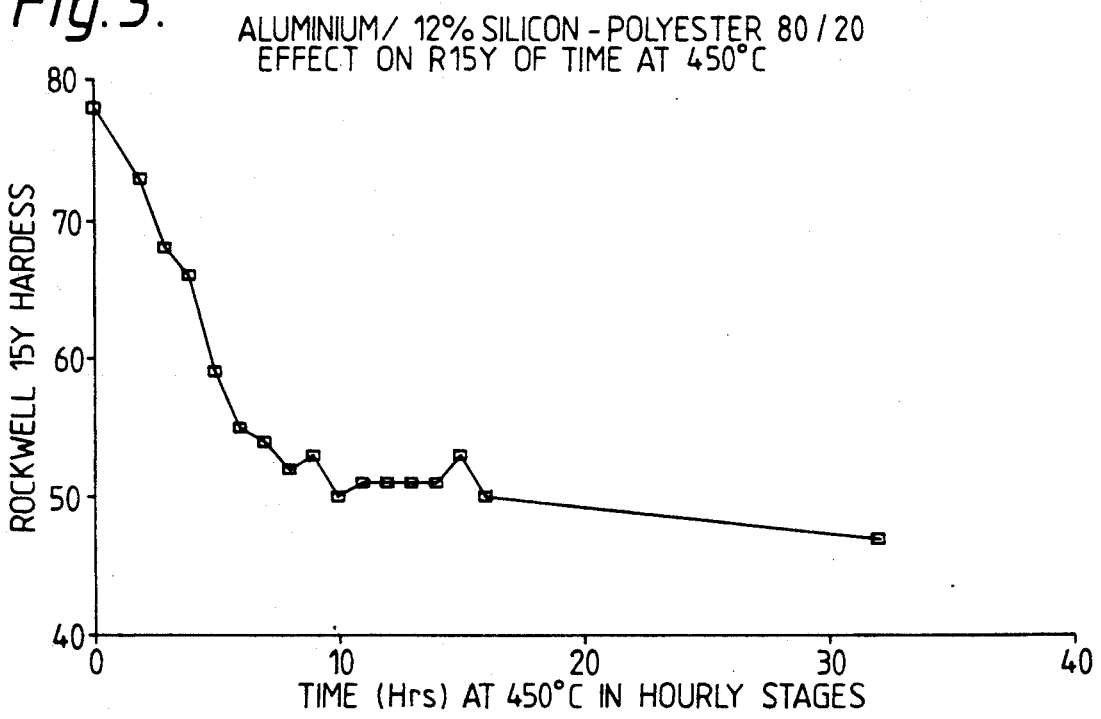
FIG. 3, is a graph which shows the effect of heat treating an abradable seal coating, consisting of an aluminium—12% silicon metallic alloy matrix with a polyester dispersoid incorporated sprayed in ratio 80:20 onto a substrate, on the hardness of the coating measured on the Rockwell R15Y indentation scale.
Figure 4:
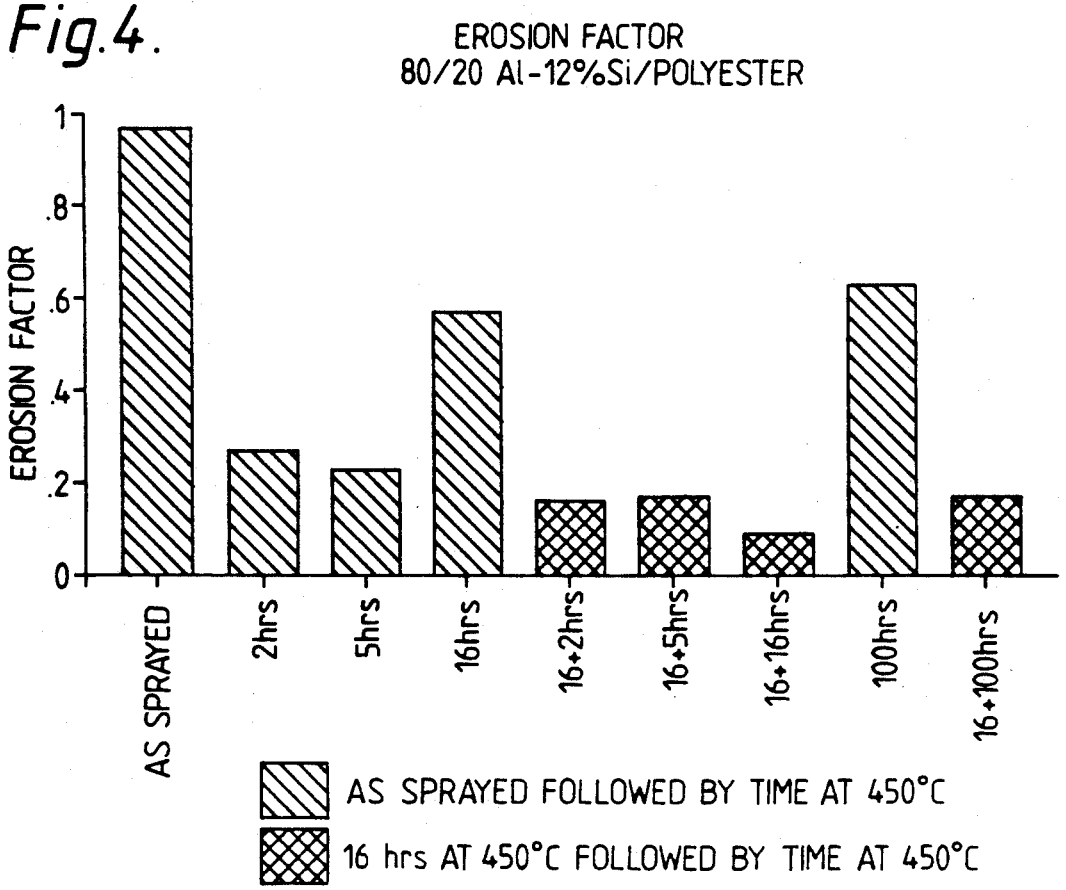
FIG. 4, shows the effect of heat treating an abradable seal coating, consisting of an aluminium—12% silicon metallic alloy matrix with a polyester dispersoid incorporated sprayed in ratio 80:20 onto a substrate, on the erosion factor of the coating.

The results of tests conducted on samples of the heat treated coatings are shown in FIGS. 3 and 4. It was found that by heat treating the coating for 16 hours at 450° C. the R15Y indentation value decreased sufficiently to give the coating the desired abradability without being too detrimental on the erosion resistance (integrity) of the coating.

From FIG. 3 it can be seen that the erosion factor after 16 hours at 450° C. was of order of 0.48, which was sufficient to maintain the integrity of the coating when a fluid flow passed over it.

Figure 2:
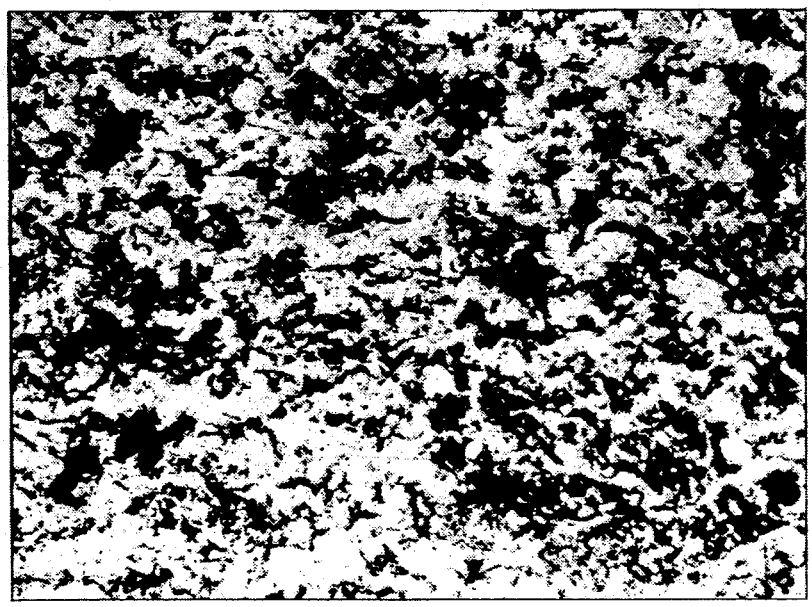
FIG. 2, shows a microsection of an abradable seal coating consisting of an aluminium 12% silicon metallic alloy matrix with a polyester dispersoid incorporated sprayed in ratio 80:20 onto a substrate and heat treated for 16 hours at 450° C.

FIG. 2 shows the structure of the coating after heat treatment at 450° C. for 16 hours. Comparing FIG. 2 with FIG. 1, it can be seen that changes have occurred leading to a more dense aluminium-silicon matrix. This structural change is accompanied by a reduction in the adhesive and interspatial strength so reducing the hardness of the coating and improving its abradability.

The results shown in FIG. 4, further show that coatings which were initially heat treated at 450° C. for 16 hours and then allowed to return to room temperature before being subjected to further time at 450° C., show slightly better erosion resistance than the coatings continually subjected to longer periods at 450° C.

It has therefore been found to be advantageous to subject a coating of a 88% aluminium—12% silicon metallic alloy matrix with a polyester dispersoid incorporated in ratio 80/20, to a heat treatment of 16 hours at 450° C. This gives an abradable seal coating for use at elevated temperature which has an improved abradability whilst maintaining its integrity.

We claim:

1. A method of manufacturing an abradable seal coating on at least one of a pair of members, the pair of members being capable of relative rotational movement and having a flow of fluid passing therethrough, comprising the steps of codepositing a first phase of a metallic alloy matrix of approximately 88% by weight of aluminum and appropriately 12% by weight of silicon and a second phase of a polyester powder onto the at least one of a pair of members capable of relative rotational movement;

said first and second phases being codeposited in a ratio, by weight, of about 80:20 respectively to form a coating of a desired depth on the at least one pair of members capable of relative rotational movement;

and heating said coating deposited onto the at least one of a pair of members capable of relative rotational movement to a temperature of 450° C. for a period of about 16 hours so that said coating is modified;

said coating being modified to have reduced hardness so that the coating is abraded when contacted by one of the pair of members whilst being capable of withstanding erosion by the flow of fluid passing therethrough.

2. A method of manufacturing an abradable seal coating as claimed in claim 1 in which the polyester powder has a mesh size of −140−+325.

3. A method of manufacturing an abradable seal coating as claimed in claim 1 in which the first and second phases are codeposited onto the at least one member by plasma spraying.

4. A method of manufacturing an abradable seal coating as claimed in claim 1 in which the first and second phases are heated prior to codepositing them onto the at least one member.

* * * * *